United States Patent [19]

Sher

[11] Patent Number: 4,995,529

[45] Date of Patent: Feb. 26, 1991

[54] STRUCTURE OF GARBAGE CAN ASSEMBLY

[76] Inventor: Cheng-Hsien Sher, No. 18, Lane 195, Nan Tai Rd., Kaohsiung City, Taiwan

[21] Appl. No.: 494,348

[22] Filed: Mar. 16, 1990

[51] Int. Cl.[5] ..... A47F 5/02

[52] U.S. Cl. ..... 220/475; 220/676; 220/908; 248/907; 248/131

[58] Field of Search ..... 220/1 T, 18, 87, 475, 220/484; 248/131, 145, 156, 284, 425, 907, 346.1

[56] References Cited

U.S. PATENT DOCUMENTS

| | | | |
|---|---|---|---|
| 836,555 | 11/1906 | Birnie | 220/18 |
| 1,207,598 | 12/1916 | Moon | 248/145 |
| 2,103,684 | 12/1937 | Long | 220/18 |
| 2,247,232 | 6/1941 | Goldberg | 248/128 |
| 3,231,126 | 1/1966 | Cotney | 220/18 |
| 3,917,104 | 11/1975 | Rossitto et al. | 220/18 |
| 4,009,818 | 3/1977 | Rogers | 248/907 |
| 4,559,747 | 12/1985 | Engel | 248/907 |
| 4,736,915 | 4/1988 | Miller et al. | 220/1 T |
| 4,856,669 | 8/1989 | Averitt et al. | 220/1 T |
| 4,905,945 | 3/1940 | Peterson | 220/1 T |

*Primary Examiner*—Stephen Marcus
*Assistant Examiner*—S. Castellano
*Attorney, Agent, or Firm*—Varndell Legal Group

[57] ABSTRACT

A garbage can assembly includes a bottom support comprising one or more support plates. When a plurality of support plates are employed, they are secured to one another in side-by-side relationship. Each of the support plates has a hole formed therethrough within which is disposed a holder plate to which a conical insert is pivoted. A garbage container includes a lateral projection having formed therein a downwardly facing opening which is also conical in configuration. This opening receives the insert for fastening the container in position over the center of gravity of the support.

9 Claims, 3 Drawing Sheets

STRUCTURE OF GARBAGE CAN ASSEMBLY

BACKGROUND OF THE INVENTION

The present invention relates to a kind of garbage can assembly for collecting garbage.

Conventional garbage cans are generally comprised of a can for containing refuse and having a wider opening on the top. Because of the design of a wider top and narrower bottom, conventional garbage cans easily fall down when they are hit by a pet or other object, causing the garbage to be scattered about. The present invention can efficiently eliminate this problem.

SUMMARY OF THE INVENTION

One object of the present invention is to provide a garbage can assembly which is stable and will not fall when it is positioned.

Another object of the present invention is to provide a garbage can assembly which has an ornamental appearance.

Still another object of the present invention is to provide a garbage can assembly which can be flexibly built up according to the location where it is to be positioned.

Still another object of the present invention is to provide a garbage can assembly which is expensive to manufacture.

According to the present invention, a garbage can assembly is comprised of a garbage can detachably connected to a bottom board by means of a fastening device. The bottom board is comprised of one or more quadrant plates according to the location where the garbage can assembly is to be positioned. The quadrant plates of the bottom board each include a round hole alternatively for the fastening therein of a fastening device so that the garbage can can be firmly secured over the center of gravity of the bottom board.

BRIEF DESCRIPTION OF THE DRAWINGS

The present invention will now be described by way of example, with reference made to the annexed drawings, in which.

DETAILED DESCRIPTION OF THE PREFERRED EMBODIMENTS

Figure 1:
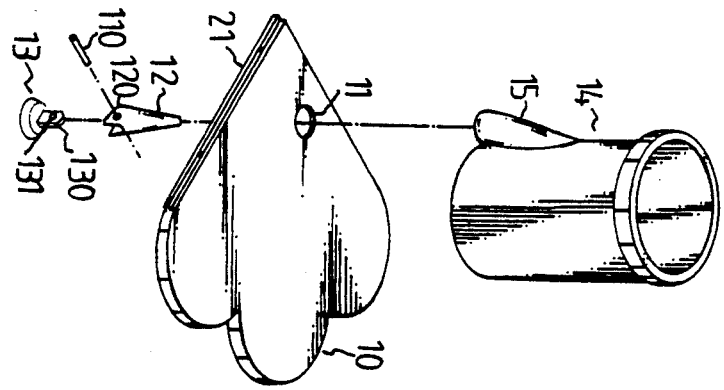
FIG. 1 is a perspective exploded view of a garbage can assembly in accordance with the present invention.
Figure 2:
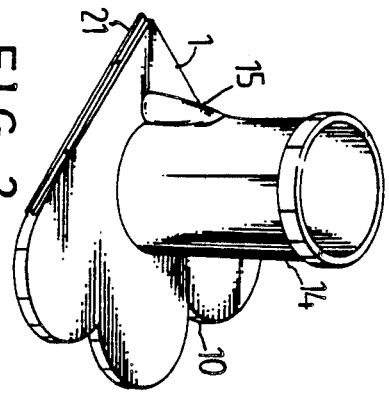
FIG. 2 is a perspective view of the embodiment of garbage can assembly of FIG. 1.
Figure 3:
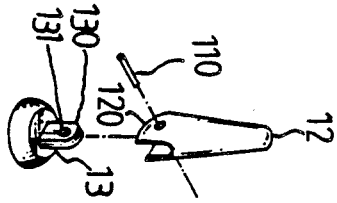
FIG. 3 illustrates a fastening device according to the present invention.

Referring to FIGS. 1 and 2, there is illustrated a quadrant plate 1 in accordance with the present invention for supporting a garbage can, which has a clover-like configuration 10 and has a round hole 11 for the fastening therein device. A fastening device of the present invention includes a conical insert 12 which has a curved bottom edge 120 and is movably connected to a holder plate 13. As illustrated in FIG. 3, the holder plate 13 comprises a vertical projection 130 having a pivot hole 131 thereon for the insertion therein of a pin 110 to pivotally secure the conical insert 12 thereto. After the conical insert 12 and the holder plate 13 are connected together and fastened in the round hole 11 of the quadrant plate 1, the bottom surface of the holder plate 13 is flush with the bottom surface of the quadrant plate 1. A garbage can 14 in accordance with the present invention comprises lateral hollow projection 15 having a conical downwardly facing opening therein into which the conical insert 12 can be tightly inserted to firmly secure the garbage can 14 to the quadrant plate 1. After the garbage can 14 is secured to the conical insert 12, it becomes stably located over the center of gravity of the quadrant plate 1.

Figure 4:
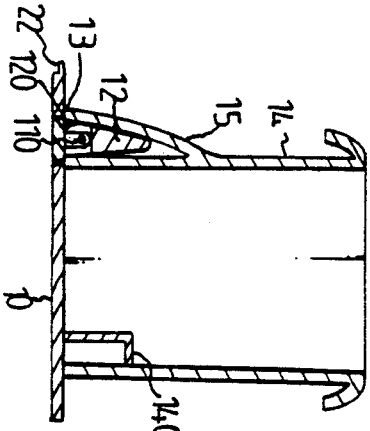
FIG. 4 is a sectional elevation of the embodiment of FIG. 2.
Figure 5:
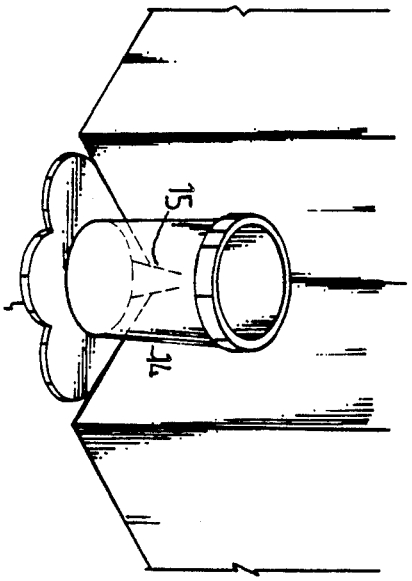
FIG. 5 is a schematic drawing, illustrating the installation of a first embodiment of garbage can assembly according to the present invention.

FIG. 4 is a sectional view illustrating the positioning of the garbage can 14 on the quadrant plate 1. After the conical insert 12 is inserted in the downwardly facing conical opening hollow, projection 15 there is little space left therebetween so that the garbage can 14 is firmly secured to the quadrant plate 1. As illustrated, the garbage can 14 comprises therein an unitary container 140 for receiving deodorant (for example, camphor pills). FIG. 5 illustrates the positioning of a garbage can assembly of the present invention in a right angle corner, in which the right angle portion of the quadrant plate 1 fits in the right angular space in the wall corner and the clover-like configuration 10 of the quadrant plate 1 is disposed at an outer side. By means of this arrangement, the garbage can assembly does not fall even if it is accidentally kicked by one's foot or hit by an object.

Figure 6:
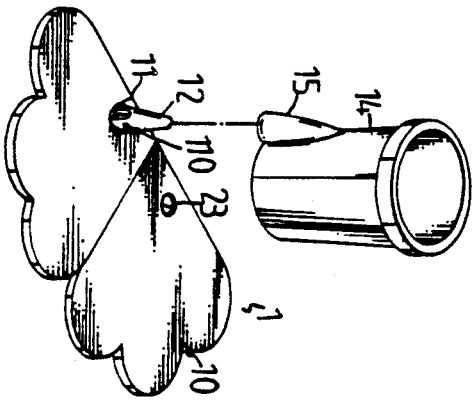
FIG. 6 is a perspective fragmentary view of an alternate form of garbage can assembly according to the present invention.
Figure 7:
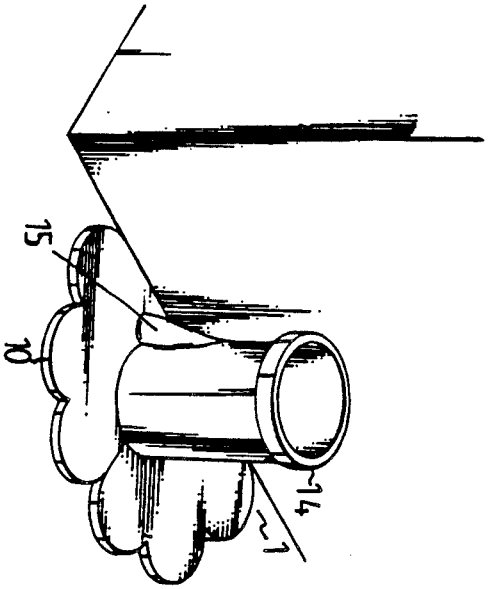
FIG. 7 illustrates the installation of the embodiment of garbage can assembly of FIG. 6.
Figure 8:
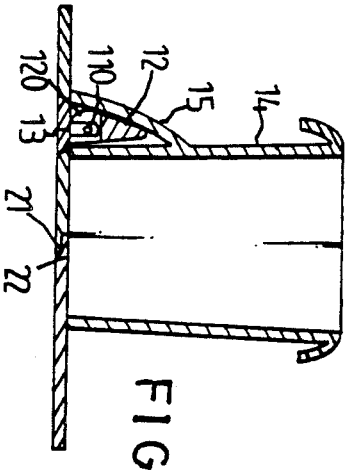
FIG. 8 is a sectional view of the embodiment of garbage can assembly of FIG. 6.
Figure 9:
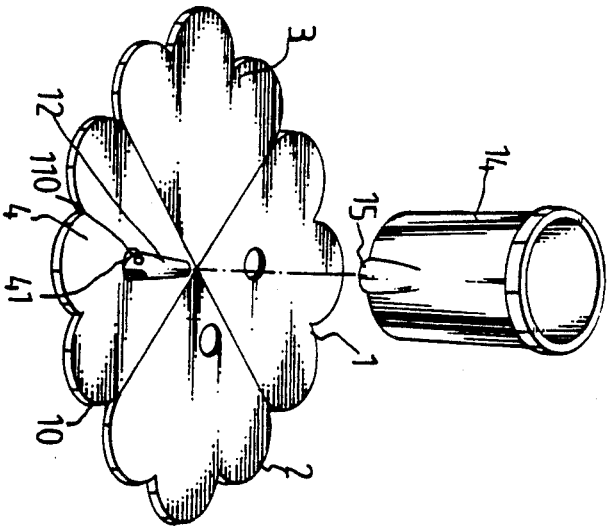
FIG. 9 is a perspective exploded view of still another alternate form of garbage can assembly according to the present invention.
Figure 11:
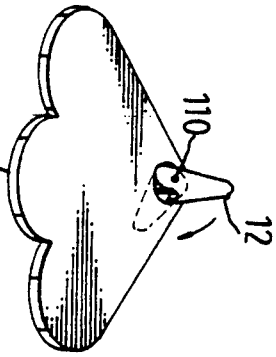
FIG. 11 is a schematic drawing illustrating the operation to adjust the angular position of a fastening device in a quadrant plate.
Figure 10:
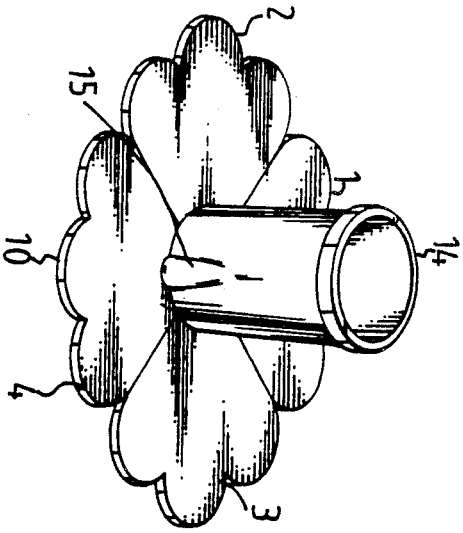
FIG. 10 is a perspective view of the garbage can assembly of FIG. 9.

Referring to FIGS. 6 through 8, therein illustrated is an alternate form of a garbage can assembly in acordance with the present invention, in which two quadrant plates 1 and 2 are connected together to form a substantially half round supporting plate. The quadrant plates 1 and 2 have a structure the same as the quadrant plate of the, aforesaid first embodiment of garbage can assembly of the present invention and each plate includes a convex strip 21 on one side and a groove 22 on its other side such that one quadrant plate can be connected to the other to form a half round plate by inserting its convex strip in the goove of the other quadrant plate. After the two quadrant plates 1 and 2 are connected together, the one of two round holes 11 and 23 thereof can be selected for the insertion therein of a conical insert 12 and a holder plate 13 so as to secure a garbage can 14 thereto. As illustrated in FIG. 7, this embodiment of garbage can assembly is suitable for placing in a position along a straight wall. Referring to FIGS. 9 and 10, therein illustrated is still another alternate form of the present invention, in which the garbage can assembly includes a garbage can 14 mounted on a substantially round plate which is formed of four quadrant plates 1, 2, 3 and 4. The quadrant plates 1, 2, 3 and 4 have a structure the same as the aforesaid embodiments. Therefore, they can be conveniently connected together to form a round plate assembly or detached for collection and delivery when not in use. During assembly, a conical insert 12 and its connected holder plate 13 can be selectively inserted in the round hole of one quadrant plate for the mounting thereon of a garbage can 14. Referring to FIG. 11, a conical insert 12 can be turned down to lie on a quadrant plate to minimize the space occupied during packaging.

I claim:

1. A garbage can assembly comprising a plurality of support plates of similar construction, each of said plates including an upper substantially flat surface and a lower substantially flat surface and a pair of substantially straight sides extending at an angle to one other, each of said plates having a hole formed therethrough and extending between said upper and lower surfaces thereof, said plates being disposed in side-by-side relationship to one another, means for connecting adjacent sides of different plates to one another so that upper and lower surface of the plates are substantially flush with one another, fastening means disposed in the hole of one of said plates and extending upwardly therefrom, a garbage container for receiving garbage, said container including a lower portion having a laterally offset projection thereon, a downwardly facing opening being formed in said projection for receiving said fastening means, said holes being positioned such that when said fastening means is disposed within one of said holes, the container is held in operative position over the center of gavity of the connected support plates.

2. A garbage can assembly comprising, a support plate including an upper substantially flat surface and a lower substantially flat surface, said plate having a hole formed therethrough and extending between said upper and lower surfaces, a garbage container for receiving garbage, said container having a lower end supported on said upper surface of the support plate, said container having formed therein a downwardly facing opening, said opening tapering to a smaller dimension in an upward direction, and fastening means for fastening said container in position on said support plate, said fastening means including a holder plate disposed within said hole, an insert movably supported by said holder plate, said insert being inserted within said opening within the container and tapering to a smaller dimension in an upward direction so as to be tightly inserted therein to hold the container in position, said hole being located in the support plate so that when the container is held in operative position, it is located over the center of gravity of said support plate.

3. An assembly as defined in claim 2, wherein said opening and said insert are of substantially conical configuration.

4. An assembly as defined in claim 2, wherein said container includes a lower portion having a laterally offset projection thereon, said opening being formed in said projection.

5. An assembly as defined in claim 2, wherein said insert is pivotally supported by said holder plate.

6. An assembly as defined in claim 2, wherein said holder plate includes a lower surface which is substantially flush with the lower surface of said support plate.

7. An assembly as defined in claim 2, wherein said assembly includes plurality of support plates, each of which is of a construction similar to that of said first-mentioned support plate, said support plates having sides thereon and said plates being disposed in side-by-side relationship to one another, means for connecting adjacent sides of different plates to one another so that the upper and lower surfaces of the plates are substantially flush with one another, said holes being positioned such that when the holder plate is disposed in the hole of one of said plates, the container is held in operative position over the center of gravity of the connected support plates.

8. An assembly as defined in claim 7, wherein each of said support plates has a pair of substantially straight sides, one of said sides including a convex strip, and the other of said sides including a groove for receiving the convex strip of a different plate to connect the plates together.

9. An assembly as defined in claim 1, wherein one of said sides of each of said plates includes a convex strip, and the other of said sides of each of said plates includes a groove for receiving a convex strip of a different plate to connect the plates together.

* * * * *